United States Patent [19]

Kisling, III

[11] Patent Number: 4,681,168

[45] Date of Patent: Jul. 21, 1987

[54] METHOD AND APPARATUS FOR RUNNING LONG TOOLS INTO AND OUT OF A PRESSURIZED ENCLOSURE

[75] Inventor: James W. Kisling, III, Kingwood, Tex.

[73] Assignee: NL Industries, Inc., New York, N.Y.

[21] Appl. No.: 792,755

[22] Filed: Oct. 30, 1985

[51] Int. Cl.[4] ..... E21B 23/00

[52] U.S. Cl. ..... 166/381; 166/70

[58] Field of Search ..... 166/378–381, 166/385, 70, 77, 77.5

[56] References Cited

U.S. PATENT DOCUMENTS

| | | | |
|---|---|---|---|
| 1,852,716 | 4/1932 | Grinnell | 166/380 X |
| 2,758,654 | 8/1956 | Simmons | 166/380 X |
| 4,317,486 | 3/1982 | Harris | 166/70 X |
| 4,591,007 | 5/1986 | Shaginian et al. | 166/77.5 X |

*Primary Examiner*—Stephen J. Novosad
*Assistant Examiner*—Thuy M. Bui
*Attorney, Agent, or Firm*—Browning, Bushman, Zamecki & Anderson

[57] ABSTRACT

A method and apparatus for running long tools into an out of pressurized enclosures includes a tool stop assembled on an access pressure lock of the enclosure and which tool stop cooperates with a segmented tool string to allow sequential assembly, insertion, withdrawal and disassembly of the tool string into and out of the enclosure. The tool string is made up of a number of tool segments interconnected by coupler/spacer members of smaller diameter than the tool sections and of shorter length. The tool catcher acts upon the thinner sections of the coupler/spacer members to fixedly hold the tool string in place for subsequent assembly/disassembly without allowing any significant pressure change in said enclosure.

5 Claims, 5 Drawing Figures

METHOD AND APPARATUS FOR RUNNING LONG TOOLS INTO AND OUT OF A PRESSURIZED ENCLOSURE

BACKGROUND OF THE INVENTION

1.Field of the Invention

The present invention relates to a method and apparatus for handling tools of substantial longitudinal length to insert the tools into and withdraw them from a pressurized container, such as a well bore.

2.Description of the Prior Art

It is necessary to periodically monitor the conditions within a producing well and, for this reason, logging tools are sent downhole on a wireline to gather the necessary data. There are two problems that are involved in accomplishing this data collection, namely, the tools are elongated tubular assemblies of relatively small diameter, in comparison their length, fashioned from short lengths of tubular members to form a single tool of perhaps 20 to 60 feet in length. At this point, it becomes quie evident that the tool will be quite difficult to handle because of its length. The tool is introduced to the well by attaching a lubricator to a blowout preventer at the top of the well casing. The lubricator is a series of large diameter tubular members assembled around the logging tool and contains, at its upper end, a grease injection tube or stuffing box through which the wireline for suspending the tool is passed. The lubricator itself is a major handling problem since it is long, heavy, difficult to manipulate in the rig and make connections, and it also is expensive. After the lubricator and stuffing box have been assembled about the tool, and the tool attached to the wireline, the assembly of the tool and lubricator is hoisted into position on the blowout preventer and secured thereto. Pressure between the borehole and lubricator is equalized by opening a bypass valve around the blowout preventer. The blowout preventer is then opened allowing access to the borehole. After the blowout preventer has been opened, the tool can be lowered into the borehole by the wireline with the grease injection tube or stuffing box providing a seal around the wireline as the tool is lowered.

The tool is extracted from the borehole by drawing it up to a position within the lubricator, closing the blowout preventer, venting the lubricator, and removing the assembly of the tool and lubricator from the blowout preventer and lowering them to a position where they can be subsequently disassembled into the individual components. It will be appreciated from the foregoing description that there are a number of difficulties in such an opertion, including knowing when the tool has been fully withdrawn into the lubricator, not drawing the wireline so taut against the stuffing box that there is a possibility of the wireline being broken with the result being the tool falling downhole before the blowout preventer can be closed and closing the blowout preventer on the tool before it is fully withdrawn into the lubricator. Of course handling the lubricator and tool during the extraction process is equally as difficult as handling them during the insertion process.

SUMMARY OF THE INVENTION

The present invention is intended to overcome the difficulties of the prior art by providing a method and apparatus which aloow relatively short and easily handled sections of a tool, such as a well logging tool, to be sequentially assembled at an enclosure entry and lowered through a pressure lock into the enclosure. The tool of the present invention is formed from a plurality of short tool string sections which are connected by spacer/couplers with the completed tool string being attached to a cable head which is attached to a wireline. Each of the spacer/couplers has an electrical conector on each end thereof, which connectors engage mating connectors on respective ends of the tool string sections. The present invention also includes a tool catcher/pressure control assembly which is mounted on a pressure lock at the entry. The tool catcher opening is generally annular member having an inwardly opening cavity on one side thereof containing a pivotal catch assembly formed by a shaft extending through the catcher cavity transverse to and spaced from the axis of the assembly with a slotted plate attached to the shaft for movement between a horizontal and a vertical position. The slot of the plate is of sufficient width to allow only the passage of a spacer/coupler therethrough so that, in the vertical position, the tool string can pass through the tool catcher and, in the horizontal position, the catcher will engage the lower end of a tool string section and hold the tool in place.

BRIEF DESCRIPTION OF THE DRAWINGS

The present invention will now be described, by way of example, with reference to the accompanying drawings in which.

DETAILED DESCRIPTION OF THE PREFERRED EMBODIMENT

Figure 1:
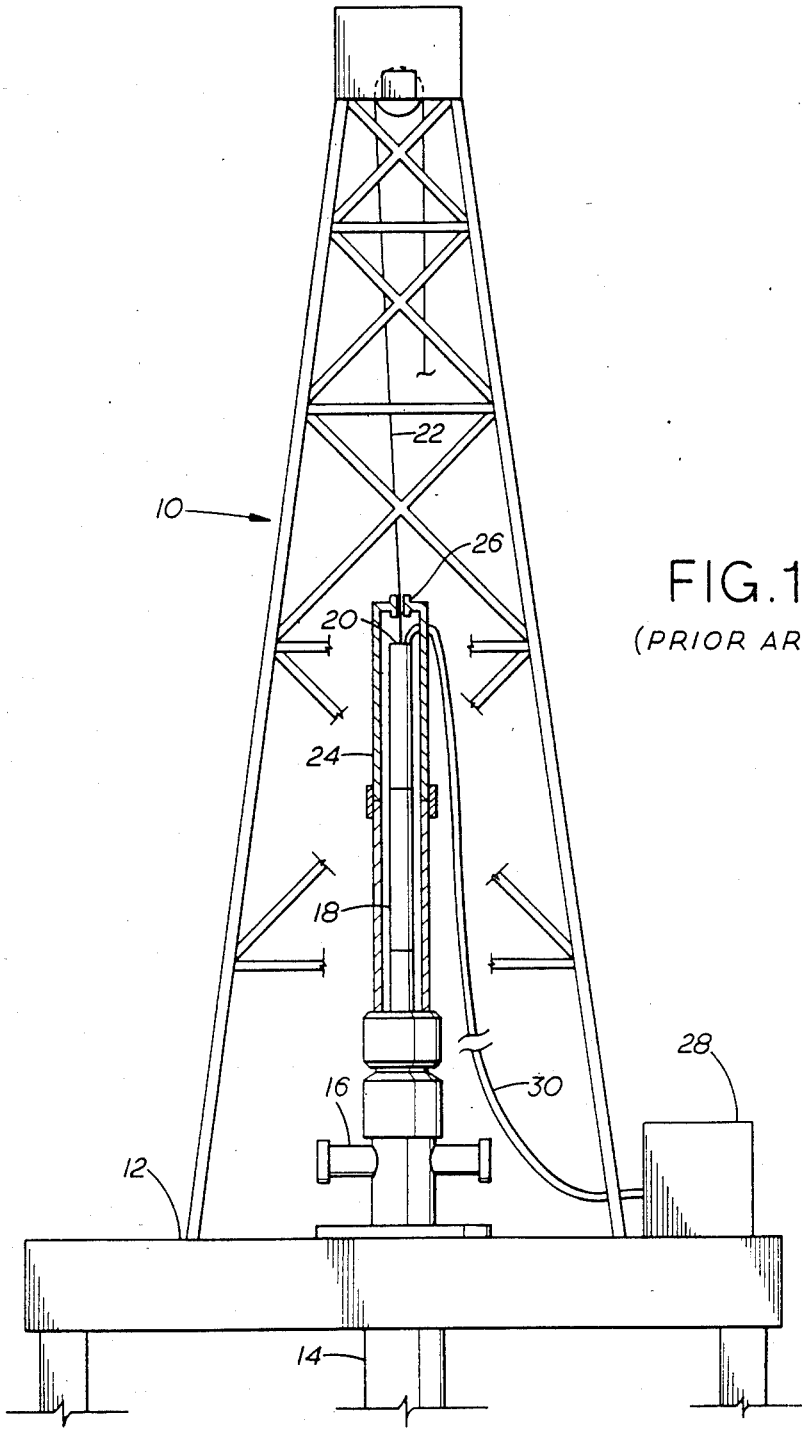
FIG. 1 (PRIOR ART)
FIG. 1 is a schematic side elevation, partly in section, showing the prior art method and apparatus for logging a producing well.

The prior art apparatus shown in FIG. 1 is a drilling rig 10 and a platform 12 positioned over a well casing 14 which closed at its upper end by a blowout preventer 16. In this conventional set up, the string tool assembly 18 is suspended by a cable head 20 from a wireline 22 within a lubricator assembly 24. The lubricator assembly 24 is secured at its lower end to the blowout preventer 16 and at its upper end is equipped with a grease junction tube or stuffing box 26 which is supplied with pressurized sealing fluid from a source 28 through a flexible conduit 30.

The prior art requires that the tool assembly 18 and lubricator assembly 24 be formed by joining together individual tool and lubrication members on the platform 12 and then be hoisted to the position shown in FIG. 1 and connected to the blowout preventer 16. It will be appreciated that a tool string 18, such as production log string, or other tool and/or instrument string, can be of substantial length, for example of 20 to 60 feet or even longer, up to the 90 feet of a normal pipe string which is about the maximum length that the standard drill rig 10 can handle. It will be readily appreciated that handling such a long assembly of tool string and lubricator will be a difficult matter requiring many skilled workers in order to prevent damage to the tool string, lubricator, blowout preventer, and rig, as well as injury to the workers.

Figure 2:
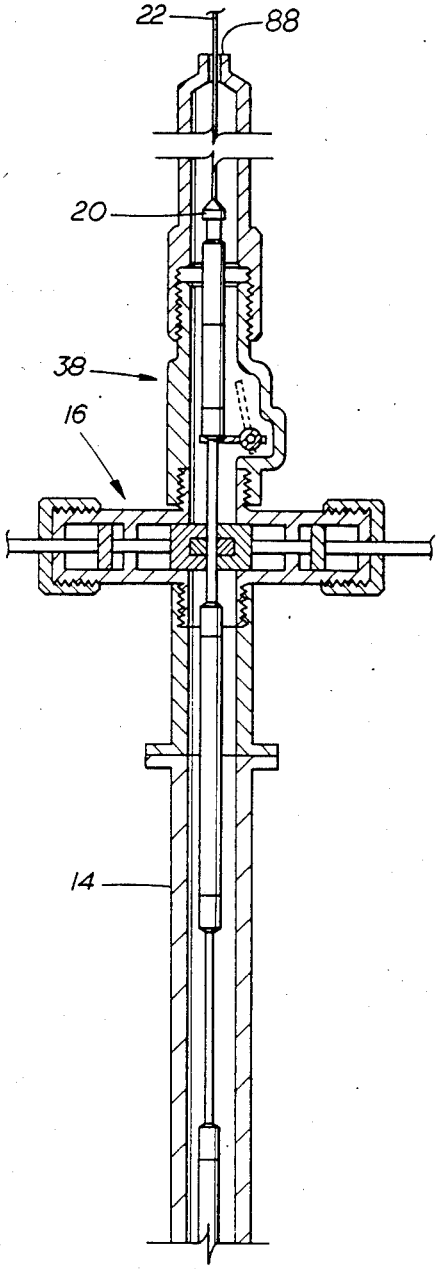
FIG. 2 is a vertical longitudinal section through a portion of a well head incorporating the present invention.
Figures 3, 4:
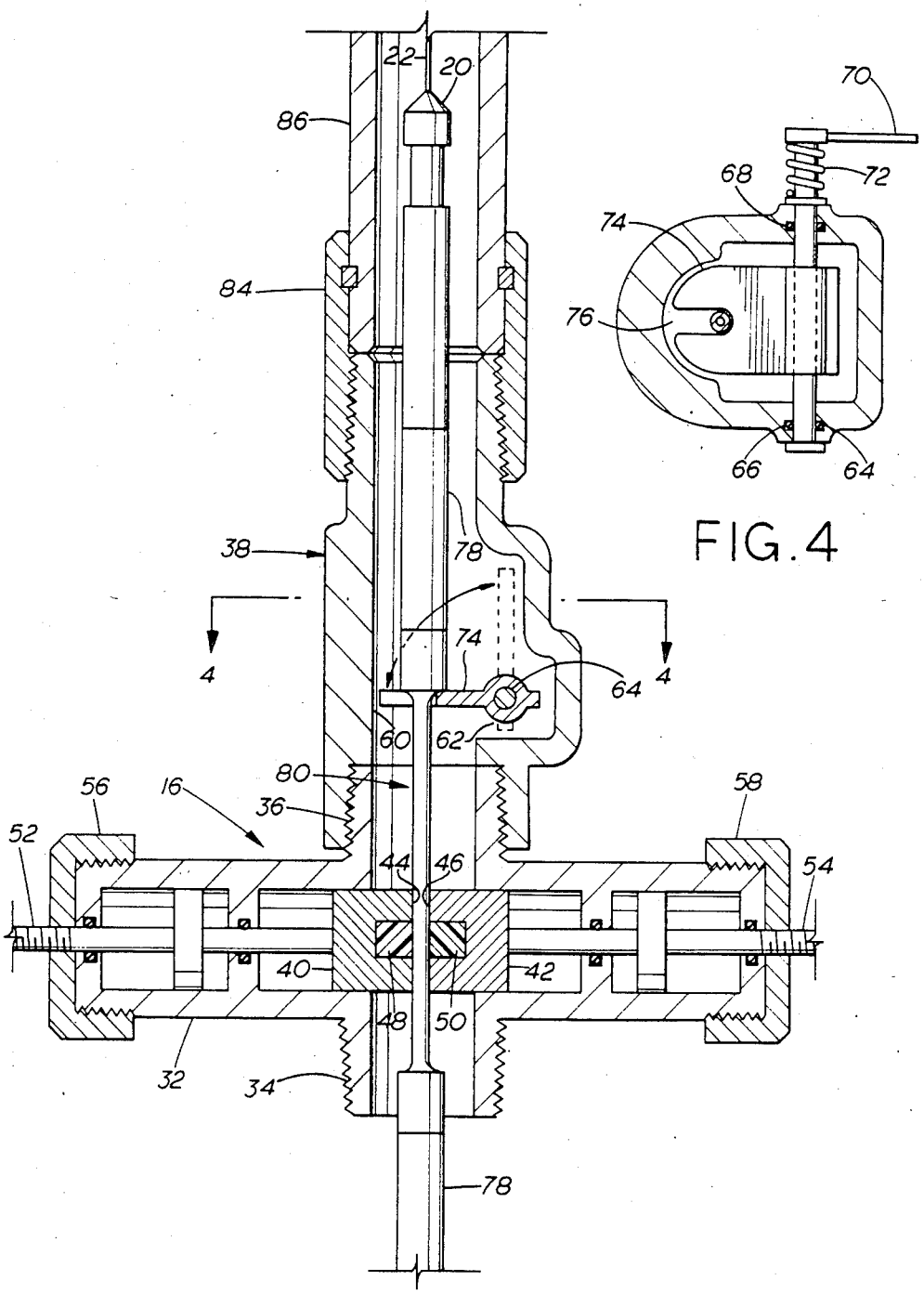
FIG. 3 is an enlarged detail section through a blowout preventer and the present invention.
FIG. 4 is a transverse section taken along line 4—4 of FIG. 3.

The present invention will be described with reference to FIGS. 2–5, with FIGS. 2 and 3 showing in somewhat greater detail the blowout preventer 16. This blowout preventer 16 is a standard device known in the well drilling industry and includes a housing 32 having a first coupling means 34 for assembly with the well casing 14 and a second oppositely directed coupling means 36 adapted to receive the tool catcher 38 thereon. The blowout preventer 16 includes a pair of rams 40, 42 having respective inwardly directed mating faces 44, 46 with mating seals 48, 50 on the ends thereof. The rams 40, 42 can be driven by either hydraulic or pneumatic piston means (not shown) or by manual screw threaded members 52, 54 extending through threaded apertures and end caps 56, 58.

The tool catcher 38 is assembled on the second coupling means 36 of the blowout preventer 16 and is a generally cylindrical member having a bore 60 with an inwardly opening cavity 62 on one side thereof. A shaft 64 extends through the cavity in a normally horizontal condition perpendicular to and spaced from the axis of the tool catcher 38. The ends of the shaft 64 are rotatable in sealed bearings 66, 68 the walls of the tool catcher and at least one end extends beyond the tool catcher, as shown in FIG. 4. The shaft 64 is provided with a handle or indicator 70 and can be biased towards the horizontal by a spring 72. Fixed to the shaft 64 is a plate 74 which can move between the illustrated horizontal position substantially closing the bore 60 of the tool catcher and a vertical position, shown in broken lines, in which the bore is completely free of obstruction. The plate has a slot 76 inwardly directed toward the axis of the bore 60. The slot 76 is narrower than a tool string member 78 but wider than a coupler/spacer member 80 so that, in the horizontal position, plate 74 will engage a coupler/spacer member 80, preventing downward movement of the drill string into the borehole. The upper end of the tool catcher 38 is provided with threads 76 which receive the coupling 84 of a lubricating member 86. The coupling 84 can be integral with the lubricating member, as shown in FIG. 2 or a separate rotatable member, as shown in FIG. 3. The upper end of the lubricating member is provided with a stuffing box 88 similar to that described with reference to the prior art.

Figure 5:
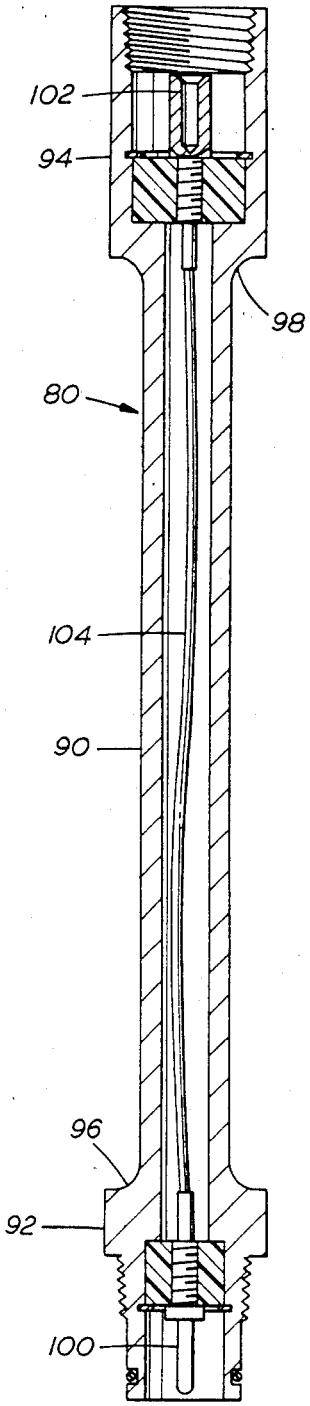
FIG. 5 is a longitudinal section through a spacer/coupler in accordance with the present invention.

The coupler/spacer member 80 of the present invention is shown in greater detail in FIG. 5. The coupler/spacer member 80 has an elongated, generally cylindrical body 90 with enlarged male and female coupling heads 92, 94 on the opposite ends thereof forming annular shoulders 96, 98. Male and female electrical connectors 100, 102 are mounted internally of body 90, at the ends thereof, and are joined by cable 104. The electrical connectors 100, 102 have been shown with a single representative terminal for the sake of simplicity. Any member and any patterned array of terminals will, of course, be used as necessary.

The present invention is utilized in the following manner: the tool catcher 38 is mounted on the blowout preventer 16 as shown in FIGS. 2 and 3. The first tool string member 78 is placed in the tool catcher 38 and will be restrained from downward movement by the plate 74. A coupler/spacer member 80 is attached to the upper end of the tool member 78 and the cablehead 20 and wireline 22 attached to the upper end thereof. The lubricating member 86 is then placed on the upper end of the tool catcher 38 and secured in place. Pressure between the wellhead and lubricator is equalized and the blowout preventer 16 and the tool catcher plate 74 opened allowing the first section of the tool be lowered into the borehole by wireline 22. The plate 74 is in a "ready-to-close" condition, biased by spring 72. When the coupler/spacer member 80 arrives in the tool catcher 38, the plate 74 rotates under the action of spring 72 to engage the shoulder 98 of the upper head 94 of the coupler/spacer thereby preventing the first tool section 78 from dropping further into the borehole. The movement of the plate 74 will be noticed by the movement of the handle 70 outside of the tool catcher 38 to give a ready visual indication of when it is time to close the blowout preventer 16. When the blowout preventer 16 is closed, it will grab the coupler/spacer body 90 and seal the well bore. The lubricating member 86 can now be removed, the cable head 20 disconnected and the next section of the tool string connected to the upper end of the coupler/spacer member 80. The lubricating member 86 is then replaced and the same sequence of events followed until the entire tool string is assembled. When the final piece is assembled, and the cable head 20 attached to the top of the tool string, the blowout preventer opened to allow the wireline to feed the tool string down through the borehole taking the necessary measurements. The logging string is removed from the well by reversing the above discussed process.

The present invention has been described with reference to introducing a well logging tool into a producing well, i.e. going into and out of an enclosure or container which is above atmospheric pressure. The invention is equally applicable to the opposite situation and could, for example, be used in a space vehicle, such as the shuttle, to assemble a tool which will be used outside of the vehicle in a zero pressure environment.

The foregoing disclosure and description of the invention is illustrative and explanatory thereof, and various changes in the method steps as well as in the details of the illustrated apparatus may be made within the scope of the appended claims without departing from the spirit of the invention.

What is claimed is:

1. An apparatus for inserting and withdrawing an elongated tool, formed by a plurality of uniform sections of a first diameter joined by connectors of a second smaller diameter, into and out of a producing well closed by a blowout preventer, said apparatus comprising:

a housing secured by one end to an upper end of said blowout preventer and defining a through bore forming an axial extension of a bore of said blowout preventer, a cavity opening inwardly into the bore of said housing, a plate mounted by a first side in said cavity movable between a first position extending from said cavity substantially blocking said bore and a second position lying within said cavity substantially freeing said bore of any obstruction;

a slot extending from a second side of said plate opposite said first side radially across at least the center of said plate, said slot being wider than said second diameter and narrower than said first diameter; and a pressure tight container adapted to be secured to the other end of said housing whereby tool segments, formed by a section and a connector, are assembled on said housing, enclosed in said container and, by opening said blowout preventer and moving said plate from the first to the second position, sequentially lowered into said well with said plate returning to said first position to engage said connector thereby holding said tool, and said tool is withdrawn from said well by reversing the process.

2. A method for inserting and withdrawing an elongated tool string into and out of a producing well comprising the steps of:

placing on a blowout preventer a tool catcher adapted to hold a tool segment above and axially aligned with said blowout preventer;

placing an assembly of a tool segment of a first diameter and a coupler/spacer of a second smaller diameter on said tool catcher;

enclosing said assembly in a pressure tight container secured to said tool catcher;

opening said blowout preventer and tool catcher to admit said assembly to said well;

closing said tool catcher on said coupler/spacer;

closing said blowout preventer on said tool; and repeating said steps as necessary to assemble and insert or remove and disassemble said tool string.

3. A method for running long tools into and out of pressurized enclosures equipped with controlled access means, comprising the steps of:

mounting a tool catcher on said controlled access means forming an axial extension thereof;

placing a tool section of a first diameter in said tool catcher;

connecting a coupler/spacer of a second smaller diameter to said tool section;

enclosing said tool section and said coupler/spacer in a container attached to said tool catcher;

equalizing pressure between said enclosure and said container;

opening said access means and said tool catcher to admit said tool section-coupler/spacer to said enclosure;

catching said coupler/spacer as it passes through said tool catcher;

closing said access means sealingly on said tool;

depressurizing and removing said container;

adding, alternately, further tool sections and coupler/spacers; and repeating the foregoing steps until all of the tool is within the enclosure.

4. The method of claim 3 further comprising the step of:

attaching a cablehead and wireline to said tool section and coupler/spacer whereby said long tool can be sequentially assembled and lowered into said pressurized enclosure.

5. An apparatus for running long tools into and out of pressurized enclosures having at least one pressure lock port, said tools having members of a first diameter connected together by coupler/spacer members of a second smaller diameter, comprising a tool catcher mounted on said lock port and having a bore forming an axial continuation of said lock port, a plate mounted in said tool catcher rotatable between a first position substantially blocking said bore and a second position clear of said bore, said plate having a radially directed slot extending into said plate opposite and normal to its axis of rotation, said slot being greater than said second diameter and smaller than said first diameter and extending at least through the center of said plate, spring means biasing said plate toward said first position; and a container adapted to be mounted on said tool catcher forming a closed extension of said bore;

whereby a tool member and a coupler/spacer are assembled, placed on the tool catcher, enclosed in said container, said port and tool catcher opened to admit said tool member-coupler/spacer and said coupler/spacer caught by said tool catcher, said port then being closed and the process continued until the entire long tool is assembled and passed through said port.

* * * * *